US008002638B2

(12) United States Patent
Grauzer et al.

(10) Patent No.: US 8,002,638 B2
(45) **Date of Patent: *Aug. 23, 2011**

(54) SMART DISCARD RACK FOR PLAYING CARDS

(75) Inventors: Attila Grauzer, Las Vegas, NV (US); Oliver M. Schubert, Las Vegas, NV (US); James V. Kelly, Las Vegas, NV (US); James B. Stasson, Eden Prairie, MN (US); Paul K. Scheper, Eden Prairie, MN (US)

(73) Assignee: Shuffle Master, Inc., Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/574,619

(22) Filed: Oct. 6, 2009

(65) Prior Publication Data

US 2010/0022311 A1 Jan. 28, 2010

Related U.S. Application Data

(63) Continuation of application No. 11/897,690, filed on Aug. 31, 2007, now Pat. No. 7,597,623, which is a continuation of application No. 10/622,388, filed on Jul. 17, 2003, now Pat. No. 7,278,923.

(51) Int. Cl.
*A63F 9/00* (2006.01)
*A63B 71/00* (2006.01)
*G01F 19/00* (2006.01)

(52) U.S. Cl. ..... 463/47; 463/1; 273/148 R; 273/149 R

(58) Field of Classification Search ..... 463/1, 11, 463/47; 273/148 R, 149 R
See application file for complete search history.

(56) References Cited

U.S. PATENT DOCUMENTS

| | | | |
|---|---|---|---|
| 4,667,959 | A | 5/1987 | Pfeiffer et al. |
| 4,750,743 | A | 6/1988 | Nicoletti |
| 5,356,145 | A | 10/1994 | Verschoor |
| 5,374,061 | A | 12/1994 | Albrecht |
| 5,605,334 | A | 2/1997 | McCrea, Jr. |
| 5,669,816 | A | 9/1997 | Garczynski et al. |
| 5,681,039 | A | 10/1997 | Miller |
| 5,722,893 | A | 3/1998 | Hill et al. |

(Continued)

FOREIGN PATENT DOCUMENTS

| | | |
|---|---|---|
| WO | WO 00/51076 | 8/2000 |

*Primary Examiner* — David L Lewis
*Assistant Examiner* — Robert Mosser
(74) *Attorney, Agent, or Firm* — Mark A. Litman & Associates, PA

(57) ABSTRACT

A discard rack moves and reads suit and rank of individual cards. The cards are provided to a card in-feed area and moved to a card collection area. Both suit and rank of each card is read in the card in-feed area or between the card in-feed area and the card collection area. The discard rack comprises a) a card in-feed area with card moving elements that move only a bottom card from a set of cards in the card in-feed area, b) a card collection area that receives cards from the card moving area in the same sense as cards are received in the card in-feed area, c) an image capture device that captures data from a card while the card is between the card in-feed area and the card collection area, d) preferably a communication port to send out captured data to a processor, and e) an elevator that lowers to maintain a level at which cards are received in the card collection area.

17 Claims, 3 Drawing Sheets

U.S. PATENT DOCUMENTS 5,772,505 A 6/1998 Garczynski et al.
5,779,546 A 7/1998 Meissner et al.
5,941,769 A 8/1999 Order
5,989,122 A 11/1999 Roblejo
6,039,650 A 3/2000 Hill
6,093,103 A 7/2000 McCrea, Jr.
6,117,012 A 9/2000 McCrea, Jr.
6,126,166 A 10/2000 Lorson et al.
6,165,069 A 12/2000 Sines et al.
6,217,447 B1 4/2001 Lofink et al.
6,250,632 B1 6/2001 Albrecht
6,267,248 B1 7/2001 Johnson et al.
6,270,404 B2 8/2001 Sines et al.
6,299,536 B1 10/2001 Hill
6,361,044 B1 3/2002 Block et al.
6,403,908 B2 6/2002 Stardust et al.
6,460,848 B1 10/2002 Soltys et al.
6,517,435 B2 2/2003 Soltys et al.
6,517,436 B2 2/2003 Soltys et al.
6,520,857 B2 2/2003 Soltys et al.
6,527,271 B2 3/2003 Soltys et al.
6,530,836 B2 3/2003 Soltys et al.
6,530,837 B2 3/2003 Soltys et al.
6,533,276 B2 3/2003 Soltys et al.
6,533,662 B2 3/2003 Soltys et al.
6,579,180 B2 6/2003 Soltys et al.
6,579,181 B2 6/2003 Soltys et al.
6,638,161 B2 10/2003 Soltys et al.

SMART DISCARD RACK FOR PLAYING CARDS

RELATED APPLICATIONS DATA

This application is a continuation of prior U.S. patent application Ser. No. 11/897,690 filed Aug. 31, 2007, now U.S. Pat. No. 7,597,623, which, in turn, is a continuation of U.S. patent application Ser. No. 10/622,388 filed Jul. 17, 2003, now U.S. Pat. No. 7,278,923. The content of these applications are incorporated by reference in their entirety.

BACKGROUND OF THE INVENTION

1. Field of the Invention

The present invention relates to components, systems, methods and apparatus for the identification, reading and or tracking of playing cards and card hands in a gaming environment, such as in casino table card games.

2. Background of the Art

Casinos and other forms of gaming constitute a very large industry. Large amounts of money are exchanged and placed at risk and it has always been a significant concern of the industry in protecting the casinos and players against fraudulent events. In casino table card games, there are generally three areas of risk in fraud, 1) falsifying/replacing playing cards, 2) falsifying/replacing chips, and 3) passing of information improperly. Casinos would also classify certain forms of play at card games as at least undesirable, if not excludable (such as card-counting).

Numerous different methods have been proposed and instituted to defend against these types of fraud. There is extensive physical surveillance of casinos, both directly by personnel and less intrusively by overhead cameras that view and record wagering and play activities. Trained personnel watch the play of games and individual players, identifying situations and events that indicate problems. Although most of these trained individuals can detect chip substitution, card exchanges and some forms of unauthorized player/dealer communications, it is difficult for the observers' attention to be maintained at the highest levels consistently.

There are other reasons for observing the play of casino table card games, such as to rate the efficiency of dealers over time, rate the efficiency of players over time, and provide a statistical basis for analysis of new games. This can assist the casino in rating players for comps and special invitations and identify preferred dealers for higher stake tables.

While some aspects of a casino's security system should be plainly visible as a deterrent, other aspects of the security should be unobtrusive to avoid detracting from the players' enjoyment of the game and to prevent cheaters and thieves from avoiding detection. Some of the current methods of tracking have drawbacks. The methods typically depend on manual observation of a gaming table. Thus coverage is not comprehensive, and is limited to tracking a relatively small number of games, customers and employees. This problem is exacerbated by a customer's ability to rapidly move between gaming tables. A commonly known method for cheating customers to avoid detection is to switch tables frequently. The tracking methods are also prone to error since the manual methods rely on human observers who can become inattentive or distracted. In one commonly known method of cheating the casino, one member of a team will create a distraction while another member steals chips or swaps cards. These manual tracking methods are also labor intensive, and thus costly.

The advance of technology in the fields of imaging, symbol recognition, computers and software has enabled the potential for greater utilization of technology to automatically provide a basis for security as opposed to merely providing a source of information for humans to evaluate. Security enhancing systems are needed in various different aspects of the play of casino table card games, and many different systems have been proposed.

U.S. Pat. No. 6,126,166 (Lorson) describes an integrated blackjack game control system having multiple sensors and output devices, electronic signal processing equipment, passive and active operator control devices, and a computer system. The system components are capable of being installed on or near existing blackjack tables and support equipment, and to operate with standard playing cards. The system performs several simultaneous functions to accelerate the play of a game of blackjack, enhance the shuffling process, and perform continuous monitoring of key dealer and table performance attributes. The system gathers information on the distribution of cards in the discard shoe from knowledge of the sequence of cards dealt during game play. When signaled, the system determines appropriate sequence, number, and positions of the pre-shuffle plug locations of the cards in the discard shoe. The system transmits the pre-shuffle card plug information to an output device driver assembly that actuates the desired output devices. In one implementation, the system output devices are light-emitting diodes, but any number of electric, acoustic, or mechanical devices could be utilized.

U.S. Pat. No. 6,299,536 (Hill) describes a playing card dispensing shoe apparatus, system and method, wherein the shoe has a card scanner which scans the indicia on a playing card as the card moves along and out of a chute of the shoe by operation of the dealer. The scanner is located on the outlet slope of the dispenser, not within any card moving element internal to the device. The scanner comprises an optical-sensor used in combination with a neural network which is trained using error back-propagation to recognize the card suits and card values of the playing cards as they are moved past the scanner, so specially coded information is not needed. The scanning process in combination with a central processing unit (CPU) determines the progress of the play of the game and, by identifying card counting systems or basic playing strategies in use by the players of the game, provides means to limit or prevent casino losses and calculate the Theoretical Win of the casino, thus also providing an accurate quality method of determining the amount of comps to be given a particular player. The shoe is also provided with additional devices that make it simple and easy to access, record and display other data relevant to the play of the game. These include means for accommodating a "customer-tracking card" which reads each player's account information from a magnetic stripe on the card, thus providing access to the player's customer data file stored on the casino's computer system, and one or more alpha-numeric keyboards and LCD displays used to enter and retrieve player and game information. Also included are keyboards on the game table so that each player can individually select various playing or wagering options using their own keyboard. The system is more focused on analysis of overall play at a table and by individuals rather then identifying specific hands and play at each round of a card game. The system evaluates individual player strategy and proficiency after the read card information is sent to a computer.

U.S. Pat. No. 4,667,959 (Pfeiffer) describes a card distribution apparatus having a card hopper adapted to hold from one to at least 104 cards, a card carousel having slots for holding cards, an injector for sequentially loading cards from the hopper into the carousel, output ports, ejectors for delivering cards from the carousel to any one of the output ports, and a control board and sensors, all housed in a housing. The apparatus is capable of communicating with selectors that are adjustable for making card selections. The injector has three rollers driven by a motor via a worm gear. A spring loaded lever keeps cards in the hopper pressed against the first roller. The ejectors are pivotally mounted to the base of the housing beneath the carousel and comprise a roller driven by a motor via gears and a centripetal clutch. A control board keeps track of the identity of cards in each slot, card selections, and the carousel position. Cards may be ordinary playing cards or other cards with bar codes added for card identification by the apparatus.

U.S. Pat. No. 4,750,743 (Nicoletti) describes a card dispensing device that requires the use of a mechanical means to advance cards out of the shoe. Specifically described is a dispenser for playing cards comprising: a shoe adapted to contain a plurality of stacked playing cards, the playing cards including a leading card and a trailing card; the shoe including a back wall, first and second side walls, a front wall, a base, and an inclined floor extending from the back wall to proximate the front wall and adapted to support the playing cards; the floor being inclined downwardly from the back wall to the front wall; the front wall having an opening and otherwise being adapted to conceal the leading card; and the front wall, side walls, base and floor enclosing a slot positioned adjacent the floor, the slot being sized to permit a playing card to pass through the slot; card advance means contacting the trailing card and adapted to urge the stacked cards down the inclined floor; card dispensing means positioned proximate the front wall and adapted to dispense a single card at a time, the card dispensing means including leading card contact means adapted for rotation about an axis parallel to the leading card, whereby rotation of the leading card contact means displaces the leading card relative to the card stack and into a predetermined position extending out of the shoe from the slot; and an endless belt located in the opening in the front wall for rotating the leading card contact means, the endless belt having an exterior surface securely engaging the leading card contact means and being adapted to be displaced by an operator.

U.S. Pat. No. 5,681,039 (Miller) describes a device for speeding the pace of a game of blackjack. The device is comprised of a housing having a top surface. A card reader for reading at least a portion of a playing card is located within the housing. An indicator cooperating with the card reader is provided to inform the dealer if his down card is of a desired value. There is also disclosed herein a method for increasing the speed of play in an organized game of blackjack. The system includes a device for reading alpha-numeric indicia on cards of a deck of playing cards in a game of blackjack to indicate to a dealer whether or not the dealer has been dealt "21," comprising: (a) a housing having a means for receiving at least a portion of a playing card when such card is disposed face down on a blackjack table; (b) means for directly reading at least a portion of the alpha-numeric indicia on said card while the card is disposed adjacent said means for receiving; and (c) means for indicating, based on the portion of the alpha-numeric indicia read, when the dealer has been dealt "21," said indicating means being connected to said means for reading.

U.S. Pat. No. 5,989,122 (Roblejo) describes an apparatus for randomizing and verifying sets of playing cards. Also, the invention relates to a processing providing such an apparatus; feeding to the apparatus one or more cards either after they have been played in a game or from an unrandomized or unverified set of cards; and manually retrieving a verified true set of cards from the apparatus. Also, the invention relates to a process of playing in a casino setting or simulated casino setting, a card game comprising providing such an apparatus, feeding unverified sets of playing cards to the apparatus, and recovering verified true sets of cards from the apparatus.

U.S. Pat. Nos. 5,605,334; 6,093,103 and 6,117,012 (McCrea) describe a secure game table system, adapted for multiple sites under a central control, for monitoring each hand in a live card game. A common deck identity code is located on each card. A shuffler has a circuit for counting the cards from a previous hand which are inserted into the shuffler and which reads the common identity code. The game control verifies that no cards have been withdrawn from the hand by a player or that new cards have been substituted. A unique code also placed on each card is read as the card is dealt to indicate the value and the suit. The game control stores this information in a memory so that a history of each card dealt is recorded. Sensors are located near each of the player positions for sensing the presence of a game bet and a progressive bet. A card sensor located near each player position and the dealer position issues a signal for each card received. The game control receives these signals and correlates those player positions having placed a game and/or progressive bet with the received cards. The game control at each table has stored in memory the winning combinations necessary to win the progressive jackpots. Since the game control accurately stores the suit and value of each card received at a particular player position, the game control can automatically detect a winning progressive combination and issue an award signal for that player position. The shoe element has the card reading components in the card withdrawal area. When integrated into a shuffling device, a camera may capture images at various positions before and at the delivery area.

U.S. Pat. No. 6,250,632 (Albrecht) describes an apparatus and method for sorting cards into a predetermined sequence. One embodiment provides a deck holding area in which cards are held for presenting a card to a read head for reading the characters on the face of the card. The apparatus also has a tray having a sequence of slots and a card moving mechanism for moving the presented card from the deck holding area into one of the slots. The tray is connected to a tray positioning mechanism for selectively positioning the tray to receive a card in one of the slots from the card moving mechanism. A controller is connected to the read head, the card moving mechanism, and the tray positioning mechanism. The controller controls the reading of each of the cards by the read head and identifies the value of each card read, and also controls the card moving mechanism to move each of the cards to a slot of the tray positioned by the tray positioning mechanism according to the predetermined sequence of values. The method for sorting includes the step of providing a tray having a sequence of slots, determining a predetermined sequence of values for the cards, and reading the face of a card to determine the value the card. The method further includes moving the read card into one of the slots of the tray. The position of the slot into which the read card is moved corresponds to the position of the value in the predetermined sequence.

U.S. Pat. No. 6,267,248 (Johnson) describes a collation and/or sorting apparatus for groups of articles. The apparatus is a sorting and/or shuffling device for playing cards. The apparatus comprises a sensor (15) to identify articles for collation and/or sorting, feeding means to feed cards from a stack (11) past the sensor (15) to a delivery means (14) adapted to deliver cards individually to a preselected one of a storing means (24) in an indexable magazine (20). A microprocessor (16) coupled to the feed means (14), delivery means (18), sensor (15) and magazine (20) determines according to a preprogrammed routine whether cards identified by sensor (15) are collated in the magazine (20) as an ordered deck of cards or a randomly ordered or "shuffled" deck.

U.S. Pat. No. 6,361,044 (Block) describes a system with a top of a card table having a card dispensing hole there through and an arcuate edge is covered by a transparent dome shaped cover. A dealer position is centrally located on the table top. A plurality of player stations are evenly spaced along the arcuate edge. A rotatable card placement assembly includes an extendable arm that is connected to a card carrier that is operable to carry a card. In response to signals from the computer, the rotation of the assembly and the extension of the arm cause the card carrier to carry the card from the card dispensing hole to either the dealer position or any of the player positions. The card carries a bar code identification thereon. A bar code reader of the card carrier provides a signal representation of the identification of the card to the computer.

U.S. Pat. No. 6,403,908 (Stardust) describes an automated method and apparatus for sequencing and/or inspecting decks of playing cards. The method and apparatus utilizes pattern recognition technology or other image comparison technology to compare one or more images of a card with memory containing known good images of a complete deck of playing cards to identify each card as it passes through the apparatus. Once the card is identified, it is temporarily stored in a location corresponding to or identified according to its position in a properly sequenced deck of playing cards. Once a full set of cards has been stored, the cards are released in proper sequence to a completed deck hopper. The method and apparatus also includes an operator interface capable of displaying a magnified version of potential defects or problem areas contained on a card which may then be viewed by the operator on a monitor or screen and either accepted or rejected via operator input. The present invention is also capable of providing an overall wear rating for each deck of playing cards.

This Patent requires identification of cards and storage of cards with the identity of the card recognized in a storage position. The cards are read and then stored in identified and recoverable positions. The identified cards are then directed, in ranked and suited order into a final collection area where the ordered deck is formed.

U.S. Pat. No. 5,779,546 (Meissner) describes a method and apparatus enabling a game to be played based upon a plurality of cards. An automated dealing shoe dispenses each of the cards and recognizes each of the cards as each of the cards is dispensed. Player stations are also included. Each player station enables a player to enter a bet, request that a card be dispensed or not dispensed, and to convert each bet into a win or a loss based upon the cards that are dispensed by the automated dealing shoe. This patent requires a system organization (betting and card calling functions at each player position and win-tracking as a result of play). The dealer shoe reads the cards one-at-a-time when driven by a single drive wheel into the card read station. The cards are fed from a sloped tray and are moved at constant speed to enable accurate reading of the cards.

U.S. Pat. No. 6,217,447 (Lofink) describes a method and system for generating displays related to the play of Baccarat. Cards dealt to each of the Banker's and Player's hands are identified as by scanning and data signals are generated. The card identification data signals are processed to determine the outcome of the hand. Displays in various formats to be used by bettors are created from the processed identification signals including the cards of the hand played, historical records of outcomes and the like. The display can also show bettors expected outcomes and historical bests. Bettors can refer to the display in making betting decisions.

The cards are read between the shoe and the player positions. "Disposed between the shoe 22 and areas 24, 26 is means for identifying the cards dealt to the Player and Banker hands. These means are embodied as any suitable card scanner 32. Scanner 32 optically scans each card 10 as it is dealt from the shoe 22 and swiped across the scanner 32, face down. When the cards 10 include [sic, include] a bar code (not shown) on their face which designates suit and denomination, the scanner 32 may be a laser scanner adapted to generate signals corresponding to the bar code. Preferably, to avoid the necessity of bar coding cards, the scanner 32 is of the type which optically scans the card face and generates data signals corresponding to the optical characteristics of the face of the card. As but an example, digital camera means can be used to generate data signals, broken in picture elements, i.e. pixels, the signal strength at the locations of the individual pixels collectively corresponding to the actual appearance of the face."

U.S. Pat. No. 5,605,334 (McCrea Jr.) It is believed that this is a disclosure of a distinct card-reading element/section/attachment to a card shuffler. The disclosure, though technically enabling in some respects, appears to be mainly prophetic, and when read in combination with U.S. Pat. No. 5,356,145 (Verschoor, which discloses the 'shuffler'), technical deficiencies are clearly apparent. The patent specification describes a complete table system and does not include a card reading discard rack. FIG. 16 of the McCrea Jr. patent is an illustration setting forth the addition of a single reader to the automatic shuffler of U.S. Pat. No. 5,356,154 (Verschoor, Nationale Stichting tot Exploitatie van Casinospelen in Nederland (Hoofddorp, NL). The shuffler is a simple card interleaving system with cards fed nearly consecutively from two separate stacks.

In FIGS. 16 and 17 is set forth another embodiment of a secure shuffler. Again, this shuffler is based upon the structure that set forth in U.S. Pat. No. 5,356,145. The shuffler 240 is mounted on a base 1600 in which is contained a camera 1610 with a lens 1620. Hence, this embodiment is self-contained and is not mounted to the table. In this embodiment, a single camera is used to record optical images of the cards dealt (as indicated by arrow 1602) and cards inserted (as indicated by arrow 1604). The inserted cards are placed in stack 93*a* and the cards dealt are dealt from stack 1230. Hence, in FIG. 16, a card 1230B is placed in the modified shoe 250 and an image is delivered as shown by arrow 1630 into a mirror 1632 and is reflected 1634 into a central mirror 1636. Likewise, card 1410B is in stack 93*a* or is delivered into stack 16*a*, by drive disk 37*a*, an image 1640 is delivered into mirror 1642 and is reflected 1644 into the central mirror 1636. The lens 1620 receives the reflected signals 1646 from mirror 1636 and delivers these optical images over lines 252 to the game control. It is to be expressly understood that images 1630 and 1640 can be obtained from a number of regions internal to shuffler 240 and that mirrors other than mirrors 1632, 1646 and 1642, can be used to reflect images into lens 1620.

U.S. Pat. No. 5,669,819 (Garczynski) describes a module for announcing when a Dealer has blackjack without exposing the face of the Dealer's down-card. The module scans a character from the Dealer's face-down standard playing card, compares the result of the scan with a set of references, and identifies the down-card. The module also receives input from the Dealer as to the identity of the Dealer's up-card, and announces whether the Dealer has blackjack or the hand continues. The module is designed to be mounted to a blackjack table such that the surface of the module on which the standard playing card rests while being scanned is in the plane of the surface of the blackjack table, allowing the Dealer to slide the down-card across the table and onto the scanner without lifting, and potentially exposing, the card's face. The module also removes the noise generated by a casino's heat, dust, cigarette and cigar ashes, and lint from the felt of the blackjack table, during the scanning process. The module further optimizes the scan of the character on the standard playing card by controlling the light intensity emitted by the components of the module used to illuminate the character.

U.S. Pat. No. 5,772,505 (Garczynski) describes a dual card scanning module announces when the symbols of a face-up standard playing card and a face-down standard playing card achieve a desired combination. The module has a scanner system that illuminates and scans at least a portion of a symbol of the face-up standard playing card and at least a portion of a symbol of the face-down standard playing card and stores the results thereof in a first and second array device, respectively. The module also has a guide to assist in receiving and positioning the cards such that the face-up standard playing card is above and aligned with the face-down standard playing card. When in this position, the symbol portions of the face-up and the face-down standard playing cards can be scanned by the array devices to generate respective scanning results. The module compares the scanning results with a memory storing a plurality of references representing respective symbols of the standard playing cards to determine if the cards have achieved the desired combination. This system requires the reading of both the face-up and face-down cards. It is believed that after review of the specification, this requirement is to be read as reading those cards in the specific positions as face-up and face-down cards and does not include reading the cards as they are withdrawn from a shoe. There is also the requirement of a display. This displays/indicates blackjacks by identification of the dealer's hole card and an up card while it is at the dealer's position. The card is not read in the discard rack after the play of the game, but at the dealer's hand position before or as the game is being played.

U.S. Pat. Nos. 6,039,650; and 5,722,893 (Hill) describes a card-dealing shoe that has a card scanner which scans indicia on a playing card as the card moves along and out of a chute by manual direction by the dealer in the normal fashion. The scanner can be one of several different types of devices which will sense each card as it is moved downwardly and out of the shoe. A feed forward neural-network is trained, using error back-propagation to recognize all possible card suits and card values sensed by the scanner. Such a neural-network becomes a part of a scanning system which provides a proper reading of the cards to determine the progress of the play of the game including how the game might suffer if the game players are allowed to count cards using a card count system and perform other acts which would limit the profit margin of the casino. The Discard Rack of the present invention is not enabled for the delivery of cards one-at-a-time, and is used after the play of the hand, not prior to resolving hands (even if resolution of wagers may be delayed until confirmation by the reading discard rack). For instance, the shoe of the Hill Patents has means for accommodating a "customer-tracking-card" or preferred customer card which reads the personal information of a card holder from a magnetic stripe on the card and this information travels with the preferred customer from game to game, throughout a casino, which the customer likes to play. An LCD display can also be part of the shoe and this display can be used to enter and retrieve vital player information as deemed necessary or desirable to the customer file opened when the magnetic stripe reader reads the preferred customer card with the customer name and account number embedded within the cards magnetic stripe. Scanned information is fed to a computer for extensive analysis.

U.S. Pat. No. 6,126,166 (Lorson) describes a system for monitoring play of a card game between a dealer and one or more players at a playing table, including a card-dispensing shoe comprising one or more active card-recognition sensors, and a signal processing subsystem. The system gathers information on the distribution of cards in a dealing shoe from knowledge of the sequence of cards dealt during game play. When signaled, the system determines appropriate sequence, number, and positions of the pre-shuffle plug locations of the cards in the discard shoe. The system transmits the pre-shuffle card plug information to an output device driver assembly which actuates the desired output devices. In one implementation, the system output devices are light-emitting diodes, but any number of electric, acoustic, or mechanical devices could be utilized. The dealer plugs the card segments as directed by the system output devices and signals completion by operating the control switch discussed above. The process is repeated until the card segments are properly positioned and then the system transmits an output signal to direct the dealer to shuffle the cards.

U.S. Pat. No. 5,941,769 (Order) describes apparatus for use in table card games. The device is for professional use in table games of chance with playing cards and gaming chips (jettons), in particular the game of "Black Jack", the object of the invention is to provide an automatically working apparatus which will register and evaluate all phases of the run of the game automatically. This is achieved by a card shoe with an integrated device for recognition of the value of the drawn cards (3') (optical recognition device and mirroring into a CCD-image converter); photodiodes (52) arranged under the table cloth (51) in order to register separately the casino light passing through each area (53, 54) for placing the gaming chips (41) and areas (55, 56) for placing the playing cards (3) in dependence of the arrangement or movement of the jettons and playing cards on the mentioned areas; a device for automatic recognition of each bet (scanner to register the color of the jettons, or a RFID-system comprising a S/R station and jettons with integrated transponder); an EDP program created in accordance with the gaming rules to evaluate and store all data transmitted from the functional devices to the computer; and a monitor to display the run of the game and players' wins.

U.S. Pat. No. 5,989,122 (Roblejo) discloses a shuffler and also additional associated systems with reading capacity. The apparatus verifies and sorts or shuffles sets of playing cards. The device includes a control means; input means for receiving playing cards into the apparatus; identification means for reading indicia on the playing cards; buffer means having a plurality of slots for temporarily holding cards; directing means for directing cards from the input means into slots in the buffer means; transporting means for moving cards from the input means to and through the identification means; stacking means; and ejecting means for ejecting cards from the slots in the buffer means into the stacking means. The identification means signals to the control means the identities of the cards and wherein the control means verifies that a true set of cards has been received in the input means and directs the ejecting means to deliver a true set of cards at the stacking means in either a random order or a sorted order.

At Global Gaming 2002, MindPlay, LLC., displayed a complete table system in the Bally Gaming booth. That system read cards from a tray prior to and after dealing, and read chips on the table with a camera. It was absolutely clear that the cards read in the tray had to be edge marked, as the cards were read without being fanned out sufficiently to display the faces of the individual cards. As all the cards were read at one time, there must have been edge reading capability. This is confirmed in U.S. Pat. No. 6,460,848 which claims and enables this edge reading capability. Cards were deposited in the tray for verification after play of the hand, again by edge-reading (that is the cards were sloped in a set so that special coded markings on the faces or backs of the cards could be read to identify the suit and rank of the cards. Standard decks could not be used in the displayed systems). Only single deck capability was possible at the time. It is not known how the software specifically related to the verification of the original deck, especially with regard to discards, double downs, etc., but some accommodation to that play was apparent in the play of the game on the displayed table.

Among the more assertive systems for blackjack (and other table game) security that have been disclosed and marketed is the MindPlay LLP casino table security system represented by U.S. Pat. Nos. 6,533,662; 6,533,276; 6,530,837; 6,530,836; 6,527,271; 6,520,857; 6,517,436; 6,517,435; and 6,460,848.

U.S. Pat. No. 6,460,848 (Soltys) particularly deals with playing card reading systems and describes a system that automatically monitors playing and wagering of a game, including the gaming habits of players and the performance of employees. A card deck reader automatically reads a symbol from each card in a deck of cards before a first one of the cards is removed from the card reader. The symbol identifies a respective rank and suit of the card. In actual use, the complete set (e.g., deck or decks) of cards is removed from the card-reading tray and dealt by hand. A chip tray reader automatically images the contents of a chip tray, to periodically determine the number and value of chips in the chip tray, and to compare the change in contents of the chip tray to the outcome of game play for verifying that the proper amounts have been paid out and collected. A table monitor automatically images the activity occurring at a gaming table. Periodic comparisons of the images identify wagering, as well as the appearance, removal and position of cards and other game objects on the gaming table. A drop box automatically verifies an amount and authenticity of a deposit and reconciles the deposit with a change in the contents of the chip tray. The drop box employs a variety of lighting and resolutions to image selected portions of the deposited item. The system detects prohibited playing and wagering patterns, and determines the win/loss percentage of the players and the dealer, as well as a number of other statistically relevant measures. The measurements provide automated security and real-time accounting. The measurements also provide a basis for automatically allocating complimentary player benefits.

The operation of the Soltys card-reading system is described as feeding of the cards into the storage area of the rack and exposing them to reading sensors that read an edge of the cards. That system reads cards after they are put into a cradle (which is a housing sized for receiving playing cards), and therefore reads all of the cards (a plurality of cards) before a first card is removed from the cradle.

WO 00/51076 (Dolphin Advanced Technologies Pty. Ltd.) describes a card inspection device having a loading area on an elevator to receive one or more decks of playing cards. A drive (e.g., feed roller) presents cards into a loading area into a card accumulation area. The card passes over a camera in the transition between areas to sense the suit and rank of the cards. The system reverses the order of the cards from the loading area to the collection area. A printer produces a record of the device's operation.

None of the references discussed above describe a discard rack that reads cards individually as the cards are collected from the table at the conclusion of play.

SUMMARY OF THE INVENTION

A smart discard rack is used to read information from a card set to identify the rank and suit of cards after they have been used in the play of a casino table card game. The cards are returned to the smart discard rack in a particular pattern of collection from the table so that the smart discard rack information can be used in conjunction with original card set suit and rank information to define elements of play in the casino table card game.

DETAILED DESCRIPTION OF THE INVENTION

Figure 1:
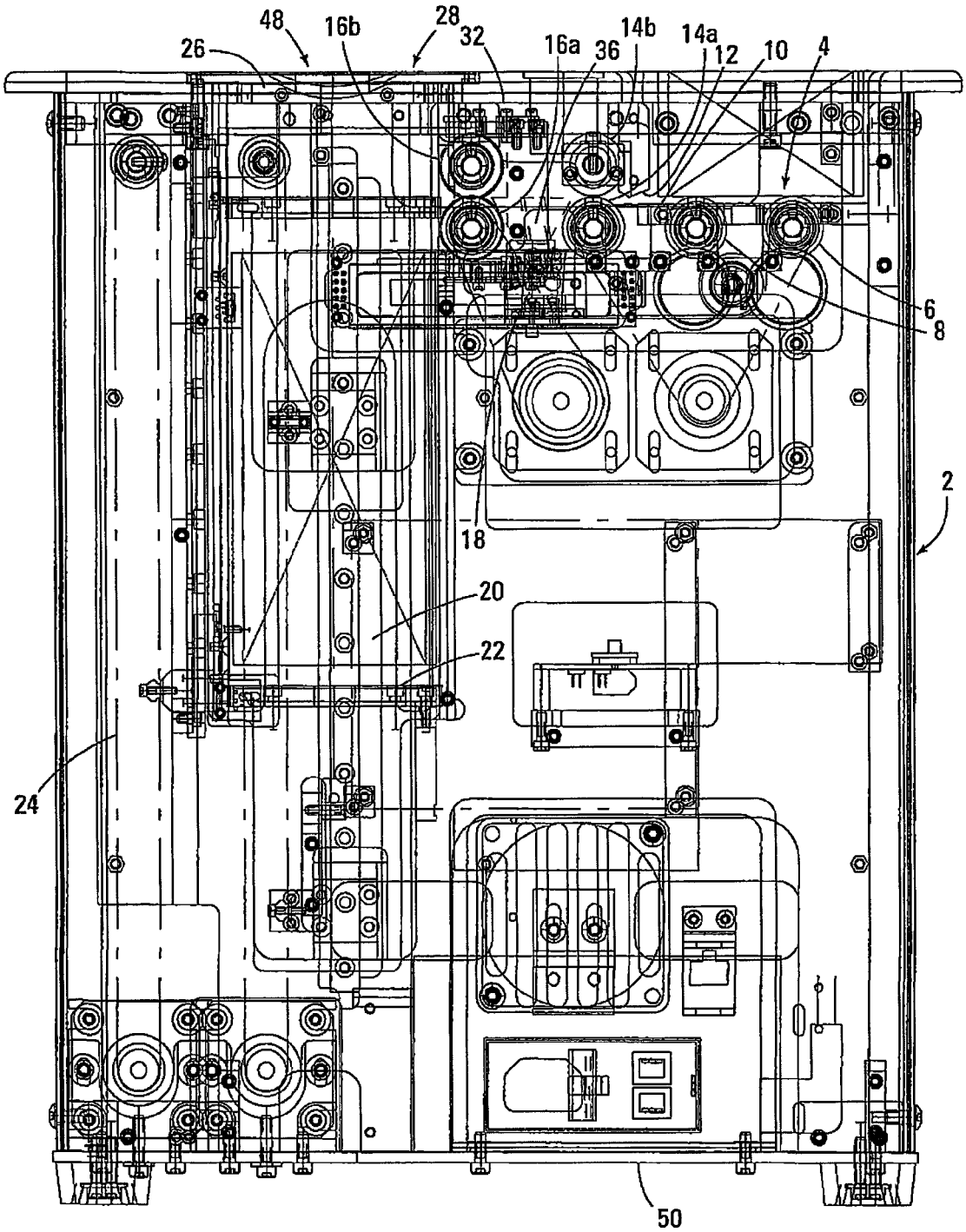
FIG. 1 shows a cutaway side view of a smart discard rack according to an embodiment of the present invention.

Card hands and card play are read by a system that comprises a card-reading delivery shoe and a card-reading discard tray of the present invention. The term "smart" is used with respect to components in the system because of their use or connection to memory and processing and/or storage intelligence (e.g., microprocessors, processors, and computers) and the use of that processing and/or storage intelligence in the practice of processes according to the teachings of the invention.

A smart card delivery shoe (which may be a stand alone unit or a component of a randomization device) is used that reads the suit and rank of each card before it is delivered to the various positions where cards are to be dealt in the play of the casino table card game. The cards are then dealt according to the rules of the game to the required card positions. Different games have diverse card distribution positions, different card numbers, and different delivery sequences that the hand identifying system of the invention must encompass. For example, in the most complex of card distribution games of blackjack, cards are usually dealt one at a time in sequence around a table, on card at-a-time to each player position and then to the dealer position. The one card at a time delivery sequence is again repeated so that each player position and the dealer position have an initial hand of exactly two cards. Complexity in hand development is introduced because players have essentially unlimited control over additional cards until point value in a hand exceeds a count of twenty-one. Players may stand with a count of 2 (two aces) or take a hit with a count of 21 if they are so inclined, so the knowledge of the count of a hand is no assurance of what a player will do. The dealer, on the other hand, is required to follow strict house rules on the play of the game according to the value of the dealer's hand. Small variances such as allowing or disallowing a hit on a "soft" seventeen count (e.g., an Ace and a 6) may exist, but the rules are otherwise very precise so that the house or dealer cannot exercise any strategy. This is a complex system in which we have attempted to provide an automated system that identifies each individual hand at a table without having to provide card-reading sensors at every player position or an overhead camera to read every card at the table. Even those expensive systems are susceptible to manipulation or fraud and do not provide maximum security.

Other cards games may provide equal numbers of cards in batches. Variants of stud poker played against a dealer, for example, would usually provide hands of three, four or five cards, three, four or five-at-a-time, respectively, to each player position and if competing against a dealer, to the dealer position. This card hand distribution is quite simple to track as each sequence of cards removed from the dealer shoe is a hand.

Other games may require cards to be dealt to players and other cards dealt to a flop or common card area. The system should also be programmable to cover this alternative if it is so desired. Other games may not provide the dealer with the dealer cards, or community cards. In this instance, other methods to designate the last hand dealt are needed.

Baccarat is closer to blackjack in card sequence of dealing, but has more rigid rules as to when hits may be taken by the player and the dealer, and each position may take a maximum of one card as a hit. The hand identification system used in connection with the discard shoe of the invention must be able to address the needs of identifying hands in each of these types of games and especially must be able to identify hands in the most complex situation, the play of blackjack.

The general operation of the system incorporating the discard rack of the invention will be described and the examples of specific implementations (e.g., smart delivery shoes, smart discard tray, software, computers, components and subcomponents) are intended to be merely exemplary and are not to be read as limiting in the scope of practice of the invention. For example, where cameras are used to read cards, the light sensitive system may be any image capture system, digital or analog, that is capable of identifying the suit and rank of a card.

A first step in the operation is to provide a set of cards to the smart delivery shoe, the cards being those cards that are going to be used in the play of a casino table card game. The set of cards (usually one or more decks) is provided in an already randomized set, being taken out of a shuffler or having been shuffled by hand. A preferred smart delivery shoe is described in copending U.S. patent application Ser. No. 10/622,321, filed the same date as this application, titled SMART DELIVERY SHOE, which application is incorporated herein in its entirety by reference for its entire disclosure of the card reading a delivery capability and structure of that device and all enabling disclosure therein. Alternative, but less preferred card delivery systems or shoes with reading capability include, but are not limited to those disclosed in U.S. Pat. Nos. 4,750,743; 5,779,546; 5,605,334; 6,361,044; 6,217,447; 5,941,769; 6,229,536; 6,460,848; 5,722,893; 6,039,650; and 6,126,166. Some of these systems require specially coded cards, which is particularly undesirable, but may be used as an alternative. The cards are read in the smart card delivery shoe, preferably one card at a time in sequence. Reading cards by edge markings and special codes (as in U.S. Pat. No. 6,460,848) requires special encoding and marking of the cards. The entire sequence of cards removed from the shoe is thus determined and stored in memory. Memory may be at least in part in the smart delivery shoe, but communication with a central processor is highly desirable and preferred. The sequence would then also or solely be stored in the central computer. If it was desired to obtain the entire sequence of cards prior to dispensing cards, the group of cards can be randomized and/or scanned in a shuffler such as the device disclosed in patent application Ser. No. 10/623,223, filed on the same date herewith, titled Card Shuffler with Card Rank and value Reading Capability.

The cards are then dealt out of the smart delivery shoe, the delivery shoe registering the card rank and suit as well as how many cards are removed one-at-a-time. This is easily accomplished by the above identified U.S. patent application where cards are fed to the dealer removal area one at a time, so only one card can be removed by the dealer. As each card is removed, a signal is created indicating that a specific card (of rank and suit) has been dealt. The computer and system knows only that a first card has been dealt, and it is presumed to go to the first player. The remaining cards are dealt out to players and dealer. In the play of certain games (e.g., stud variants) where specific numbers of cards are known to be dealt to each position, the shoe may be programmed with the number of players at any time, so hands can be correlated even before they have been dealt. If a stud variant is being played, where each player and the dealer gets three cards (Three Card Poker™ game), the system will know in advance of the deal what each player and the dealer will have as a hand. It is also possible that there be a signal available (particularly desirable in blackjack) when the dealer has received either his first card (e.g., when cards are dealt in sequence, one-at-a-time) or has received his entire hand. The signal is desirable as that signal can be readily used to automatically determine the number of player positions active on the table at any given time. For example, if in a hand of blackjack the dealer receives the sixth card, the system will immediately know that there are five players at the table. The signal can be given manually (pressing a button at the dealer position or on the smart card delivery shoe) or can be provided automatically (a card presence sensor at the dealer's position, where a card can be placed over the sensor to provide a signal). Where an automatic signal is provided by a sensor, some physical protection of the sensor is preferably provided, such as a shield that would prevent accidental contact with the sensor or blockage of the sensor. An L-shaped cover would be very desirable so a card could be slid under the arm of the L parallel to the table surface and cover the sensor under that branch of the L. The signal can also be given after all cards for the hand have been delivered, again indicating the number of players, For example, when the dealer's two cards are slid under the L-shaped cover to block or contact the sensor, the system will know the total number of cards dealt on the hand (e.g., 10 cards), know that the dealer has 2 cards, determine that players therefore have 8 cards, and know that each player has 2 cards each, thereby absolutely determining that there are four active player positions at the table (10−2=8 and then 8/2=4 players). This automatic determination is highly desirable as opposed to having dealers input the number of players each hand at a table or having to manually change the indicated number of players at a table each time the number changes. The use of a dealer activation device or completely automatic signal generating device would be needed in cases where the dealer does not receive cards.

Once all cards have been dealt, the system knows what cards are initially present in each player's hand, the dealer's hand, and any flop or common hand. The system operation is now simple when no more cards are provided to play the casino table game. All hands are then known and all outcomes can be predicted. The complication of additional cards will be addressed with respect to the game of blackjack.

After dealing the initial set of two cards per hand, the system cannot immediately know where each remaining card will be dealt. The system does know what cards are dealt, however. It is with this knowledge and a subsequent identification of discarded hands that the hands and cards from the smart delivery shoe can be reconciled or verified. Each hand is already identified by the presence of two specifically known cards. Hands are then played according to the rules of the game, and hands are discarded when play of a hand is exhausted. A hand is exhausted when 1) there is a blackjack, the hand is paid, and the cards are cleared; 2) a hand breaks with a count over twenty-one and the cards are cleared; and/or a round the game is played to a conclusion, the dealer's hand completed, all wagers are settled, and the cards are cleared. As is typically done in a casino to enable reconciling of hands manually, cards are picked up in a precise order from the table. The cards are usually cleared from the dealer's right to the dealer's left, and the cards at each position comprise the cards maintained in the order that they were delivered, first card on the bottom, second card over the first card, third card over the second card, etc. maintaining the order or a close approximation of the order (e.g., the first two cards may be reversed). Maintaining the order is important as the first two cards form an anchor, focus, basis, fence, end point or set edge for each hand. For example, if the third player position was known to have received the 10 of hearts (10H) and the 9 of spades (9S) for the first two card, and the fourth player was known to receive the 8 of diamonds (8D) and the 3 of clubs (3C) for the first two cards, the edges or anchors of the two hands are 9S/10H and 8D/3C. When the hands are swept at the conclusion of the game, the cards are sent to the smart discard rack of this invention and the swept cards consist of 9S, 10H, 8S, 8D and 3C (as read by the smart discard rack), the software of the processor will automatically know that the final hands in the third and fourth positions were a 9S and 10H for the third hand 8D and 3C originally plus the 8S hit for the fourth hand. The analysis by the software specifically associates the extra card with the fourth hand with the specific cards read by the smart discard shoe. The information from reading the exhausted hands is compared with the original information collected from the smart delivery shoe. The smart delivery shoe information when combined with the smart discard rack information shall confirm the identity of each hand, even though cards were not uniformly distributed (e.g., player one takes two hits for a total of four cards, player two takes three hits for a total of five cards, player three takes no hit for a total of two cards, player four takes one hit for a total of three cards, and the dealer takes two hits for a total of four cards). If fewer than all player positions were occupied, a position sensor or bet sensor could be used to associate the hand with a particular hand position. An example of one chip sensing system is disclosed in Schubert U.S. Pat. No. 6,313,871, the content of which is incorporated herein by reference.

The dealer's cards may be equally susceptible to analysis in a number of different formats. After the last card has been dealt to the last player, a signal may be easily and imperceptibly generated that the dealer's hand will now become active with possible hits. For example, with the sensor described above for sensing the presence of the first dealer card or the completion of the dealer's hand, the cards would be removed from beneath the L-shaped protective bridge. This type of movement is ordinarily done in blackjack where the dealer has at most a single card exposed and one card buried face down. In this case, the removal of the cards from over the sensor underneath the L-cover to display the hole card is a natural movement and then exposes the sensor. This can provide a signal to the central processor that the dealer's hand will be receiving all additional cards in that round of the game. The system at this point knows the two initial cards in the dealer's hand, knows the values of the next sequence of cards, and knows the rules by which a dealer must play. The system knows what cards the dealer will receive and what the final total of the dealer's hand will be because the dealer has no freedom of decision or movement in the play of the dealer's hand. When the dealer's hand is placed into the smart discard rack, the discard rack already knows the specifics of the dealer's hand even without having to use the first two cards as an anchor or basis for the dealer's hand. The cards may be treated in this manner optionally, but it is not essential.

When the hands are swept from the table, dealer's hand then players' hands from right to left (from the dealer's position or vice-versa if that is the manner of house play), the smart discard rack reads the shoes, identifies the anchors for each hand, and the computer identifies the individual hands and reconciles them with the original data from the smart delivery shoe. The system thereby can identify the composition of each hand played (i.e. number of cards, rank and suit of each card) and provide system assurance that the hand was played fairly and accurately.

If a lack of reconciling by the system occurs, a number of fault events can occur. A signal can be given directly to the dealer position, to the pit area, or to a security zone and the cards examined to determine the nature of the fault and cause of the error and inspect individual cards if necessary. When the hand and card data is being used for various statistical purposes, such as evaluating dealer efficiency, dealer win/loss events, player efficiency, player win/loss events, statistical habits of players, unusual play tactics or meaningful play tactics (e.g., indicative of card counting), and the like, the system may file the particular hand in a 'dump' file so that hand is not used in the statistical analysis, this is to assure that maximum benefits of the analysis are not tilted by erroneous or anomalous data.

A review of the figures will assist in a better understanding of the discard rack apparatus and method of the present invention.

Figure 3:
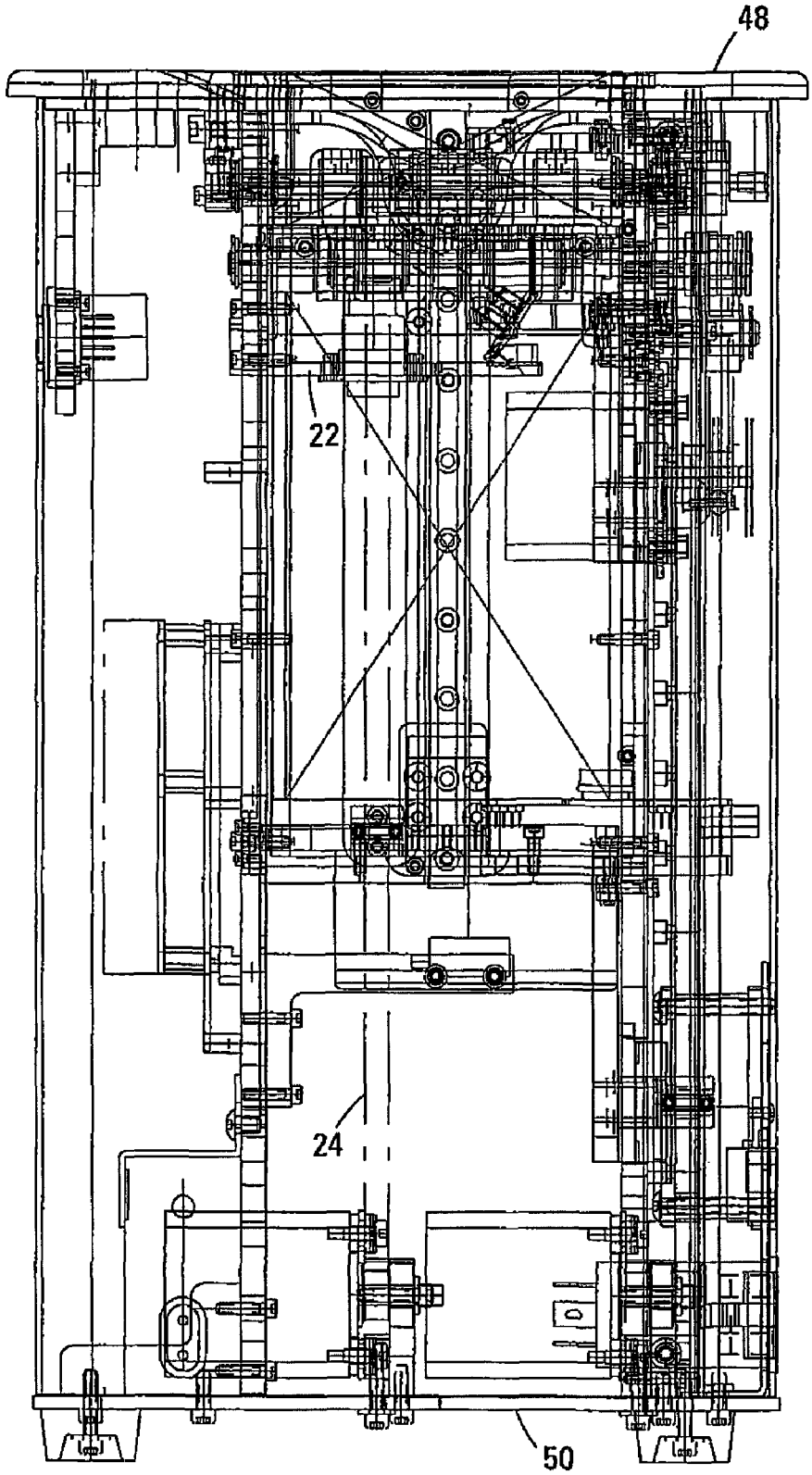
FIG. 3 shows an end cutaway top view of a smart discard rack according to an embodiment of the present invention.

FIG. 1 shows a side cutaway view of a smart discard rack 2 of an embodiment of the present invention. The following discussion can be best understood by referring to both FIGS. 1 and 3. The smart discard rack 2 has a hand insert area 4 where cards are inserted (e.g., one hand at a time, or one card at a time, or groups of exhausted or unused cards in a batch), usually after the completion of play in a casino table card game. Pick-off rollers 6 and 8 move cards individually from the bottom of the stack of cards (not shown) in the hand insert area 4 one at a time through opening 10 from the hand insert area 4. A sloped or beveled face 12 is provided to assure proper horizontal orientation of moving cards and to prevent jamming at this position.

After a card is moved through the opening 10, a first additional set of nip rollers 14*a* and 14*b* (which may be referred to as brake rollers, of first nip rollers 14) engages and directs the card. When the card (not shown) is between the first set of nip rollers 14*a* and 14*b*, and the second set of nip rollers 16*a* and 16*b* (which may be referred to as speed-up rollers 16), the cards are positioned with their card faces (with suit and rank symbols facing downwardly to the bottom 50 of the smart discard rack 2. An image capture device 18 which is capable of reading the symbols on the cards, and especially standard suit and rank symbols on the comers of the cards, is positioned to read the intended symbols on the cards are positioned above and between the first set of nip rollers 14*a* and 14*b*, and the second set of nip rollers 16*a* and 16*b* to sense the position of cards. The sensor may be in other locations (such as on the side of the card or below the card or at an angle) if desired. The sensors 32 and 34 signal the position of edges of the cards as they are moved. Additional sensors (not shown) may be present in other locations such as in the hand insert area 4 and in the card collection area 20. The sensors 32 and 34 indicate when the individual cards to be read will be in a desired or optimum position for symbols on the card to be read by image capture device 18. For example, to conserve memory in the computer and reduce information flow, it would be desirable to limit image information to the symbols of each card, rather then having the camera image and report a constant stream of data on the entire face of each card and the empty space between cards. For example, when sensor 34 indicates the presence of a new edge of a card, the camera 18 will be triggered and a snapshot taken. The focal point or focal plane 36 of the camera 18 will encompass the symbols to be read on the card, usually only the upper left hand corner of a playing card. The symbol will be imaged and the data from the image read by available image reading software.

A desirable set of image capture devices (e.g., a CCD automatic camera) and sensors (e.g., light-emitting devices and light capture devices) will be described, although a wide variety of commercial technologies and commercial components are available. A preferred camera is the "Dragonfly™" automatic camera provided by Point Grey Corporation an includes a 6 pin IEEE-1394 interface, asynchronous trigger, multiple frame rates, 640×480 or 1024×724 24-bit true color or 8-bit gray scale images, image acquisition software and plug-and-play capability. This can be combined with commercially available symbol recognition software. The commercially available symbol recognition software is trained on card symbols and taught to report image patterns as specific card suits and ranks. Once a standard card suit/rank recognition program has been developed, the training from one format of cards to another becomes more simply effected and can be done at the casino table or by a security team before the smart discard rack 2 is placed on the table. Position sensors (e.g., 32 and 34) can be provided and enhanced by one of ordinary skill in the art from commercially available components that can be fitted by one ordinarily skilled in the art. For example, various optics such as SICK WT2S-N111 or WL2S-E11; OMRON EE SPY302; or OPTEK OP506A may be used. A useful encoder can be purchased as US Digital encoder 24-300-B. An optical response switch can be provided as MicroSwitch SS541A.

Once the symbol has been imaged, a signal is sent to a central processor where the information of the suit and rank of the individual cards is processed according to the objectives of the system. In one form of the invention, the processor is part of the discard rack. In another form, the processor is a separate game computer or casino host computer. After each card has been read, the individual cards are moved us in another form, the processor or a separate game computer or casino host computer by rollers 16*a*/16*b* to be deposited in the card collection area 20. Cards are delivered into the card collection area 20 by being placed on support tray 22. The height of the tray 22 is adjusted by belt drive 24 so that the top card (not shown) on the tray 22 or the surface of the tray 22 if no cards are present, is slightly below the level at which cards are fed from rollers 16*a*/16*b* into the card collection area 20. This prevents cards from having to fall onto a collection of cards and possible upturn. The support tray 22 is preferably moved in only a single direction (downwardly) as individual cards are fed into the collection area 20. By maintaining the identical order of cards fed from the hand insert area 4 to the card collection area 22, manual reconciling of hands or game play can be enabled.

After all cards have been delivered to the card collection area 20, the support plate 22 is elevated to expose the set of cards through an opening 26 at the top 48 of the smart discard rack 2. There may be a manually operable or an automatically openable cover 28 over the card collection area so that the set of cards can be raised over the top surface 48 by the elevated support plate 22 and the card set removed.

Figure 2:
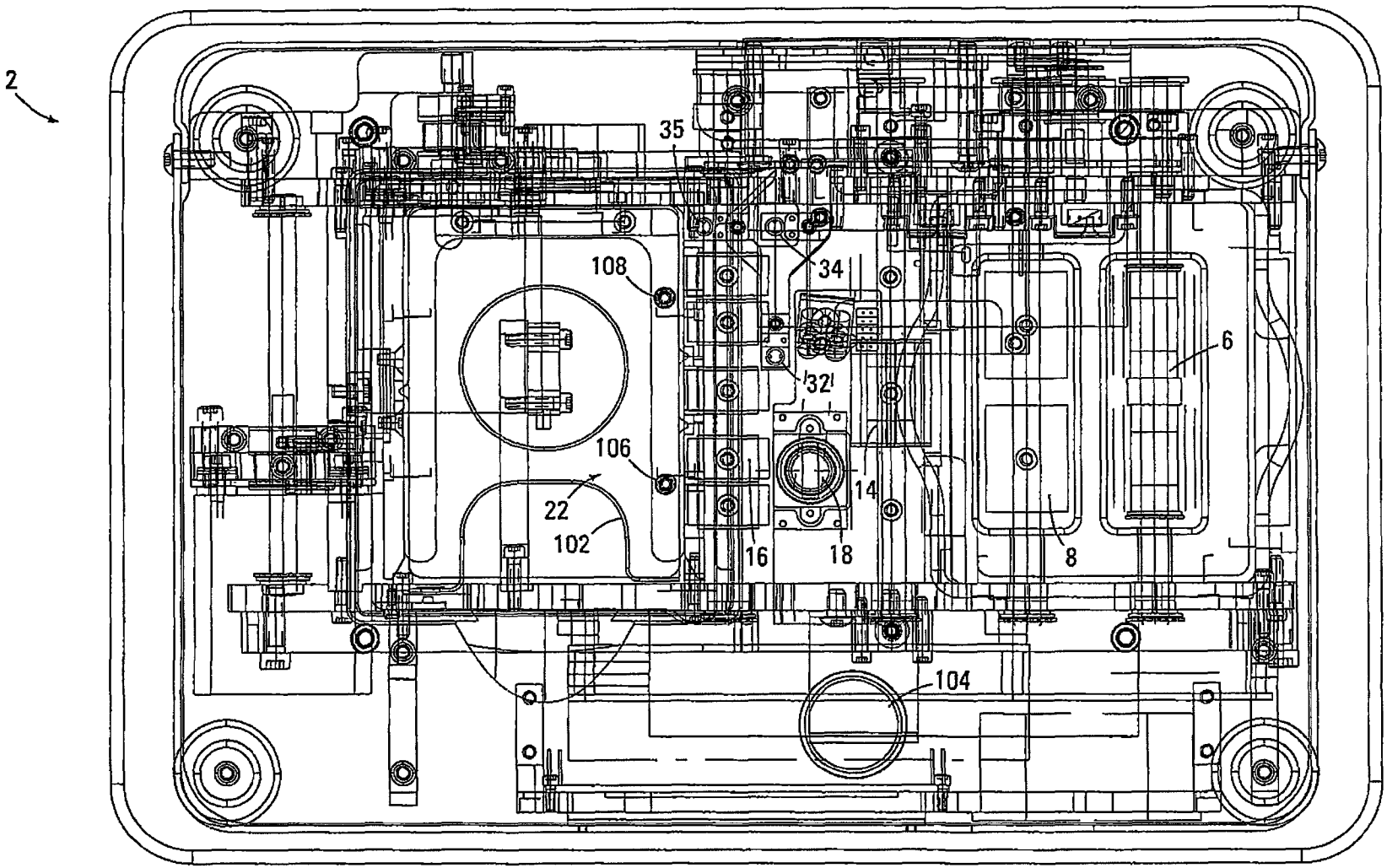
FIG. 2 shows a side cutaway top view of a smart discard rack according to an embodiment of the present invention.

FIG. 2 shows a top cutaway view of an embodiment of the smart discard rack 2 of the present invention. All numbered elements having the same numbers as in FIG. 1 and are the same elements from a different perspective. The support plate 22 is shown with an ergonomic opening 102 to assist in manual removal of cards. Sensors 106 and 108 are used to detect card jams or the like or track the number of cards moved through rollers 16 onto the card collection or support tray 22. Button 104 may be an on-off switch or jam recovery switch or the like.

It is always possible for cards to jam, misalign or stick during internal movement of cards through the discard rack. There are a number of mechanisms that can be used to effect jam recovery. The jam recovery may be based upon an identified (sensed) position of jam or may be an automated sequence of events. Where a card jam is specifically identified by the sensed position of a jammed card in the device (and even the number of cards jammed may be estimated by the dimensions of the sensed image), a jam recovery procedure may be initiated at that specific location. A specific location in FIG. 1 within the dealing shoe (e.g., between and inclusive of rollers 14 (i.e., 14*a* and 14*b*) and 16 (i.e., 16*a* and 16*b*) will be discussed from an exemplary perspective, but the discussion relates to all other positions within the device.

If a card is sensed (e.g., by sensors 18 and/or 20) as jammed between rollers 16*a*/16*b* and 114*a*/14*b* (e.g., a jam occurs when cards will not move out of the position between the rollers and cards refuse to be fed into that area), one of a various number of procedures may be initiated to recover or remove the jam. Among the various procedures which are discussed by way of non-limiting examples include at least the following. The rear-most set of rollers (14*a* and 14*b*) may reverse direction (e.g., 14*a* begins to turn clockwise and 14*b* begins to turn counterclockwise) to reverse a direction of movement of the jammed card and to remove the jammed card from between the rollers (14*a* and 14*b*) and have the card extend backwards into the space 14, without attempting to reinsert a card into the stacking area 4. The reversed rotation may be limited to assure that the card remains in contact with the rollers 14*a* and 14*b*, so that the card can be moved back into progression through the dealing shoe. An optional part of this reversal can include allowing rollers 16*a* and 16*b* to become free rolling to release contact and tension on the card during the reversal. The reversed rotation may be smoothly run or episodic, attempting to jerk a jammed card from its jam position. If that procedure does not work, or as an alternative procedure, both sets of rollers 16*a*/16*b* and 14*a*/14*b* may reverse at the same time or in either sequence (e.g., 14*a*/14*b* first or 16*a*/16*b* first) to attempt to free the jam of a card. When one set of rollers only is turning, it is likely to be desirable to have the other set of rollers in the area of the jam to become free rolling. It is also possible to have the rollers automatically spaced further apart (e.g., by separating roller pairs to increase the gap in the potential nip between rollers) to relieve tension on a card and to facilitate its recovery from a jam. The adjacent pairs of rollers (e.g., 16*a*, 16*b* and 14*a*, 14*b*) can act in coordination, in sequence, in tandem, in order, independently or in any predefined manner. For example, referring to the roller sets as 14*a*/14*b* and 16*a*/16*b*, the recovery process may have the rollers act as a) (14-16) at the same time in the same direction), b) (14-16) at the same time in the opposite directions to assist in straightening out cards, c) (14*a*/14*b* then 16*a*/16*b*) to have the rollers work sequentially, d) (16*a*/16*b* then 14*a*/14*b*) to have the rollers work in a different sequence, e) 14 only for an extended time, and then 16 operating alone or together with 14, f) 16 only for an extended time or extended number of individual attempts and then 14 for a prescribed time, etc. As noted earlier, a non-active roller (one that is not attempting to drive or align cards) may become free-rolling during operation of another roller.

These various programs may be performed at a single jam location in series or only a single program for jam recovery. In addition, as the card may have been read at the point of the jam or before the jam, the rank and value of the card jammed may be identified and this can be displayed on the display panel on the dealing shoe, on the central computer or on a shuffler connected to the dealing shoe, and the dealer or pit boss may examine that specific card to make certain that no markings or damage has occurred on that card which could either cause further problems with the dealing shoe or shuffler or could enable the card to be identified when it is in the dealing position in the shoe at a later time. The pit crew can then correct any problem by replacement of that specific card, which would minimize down time at the card table. Also, if a jam cannot be recovered, the delivery shoe would indicate a jam recovery failure (e.g., by a special light or alphanumeric display) and the pit person or dealer would open the device and remove the jam manually.

Individual playing cards (not shown) may be read at one or more various locations within the card discard rack 2. Information may be read by the card reading image capture device by either continuous reading of all image data in the card pre-delivery area or by triggered on-off imaging of data in a specific region of cards as the presence of a card is sensed within a pre-delivery (prior to the card collection area) area. For example, optical card presence sensors may activate the camera. This sensor is preferably not a camera. A light source (not shown) may be provided to enhance the signal to the camera sensor. That specific region of cards is preferably a corner of the card wherein complete value information (and possibly suit information) is readable on the card, such as a corner with value and suit ranging symbols on the card. By using on-off or single shot imaging of each card, the data flow from the sensor/card reading element is minimized and the need for larger memory and data transmission capability is reduced in the system.

Information may be transferred from the card reading elements from a communication port or wire for the sensor/reading element. Cards may be buffered or staged at various points within the discard rack, such as where restrained by rollers 16 so that cards partially extend towards the card collection area 20 past the rollers 16 and the like. Cards may partially overlap in buffering as long as two or more cards are not present between a single set of nip rollers where nip forces may drive both cards forward at the same time.

Among the other notable features of the smart discard rack are at least the following elements: After cards have been read before or during deal, the cards are returned after play of a hand to the smart discard rack for reading, storage and ultimately return to a shuffler. Hands can be returned one by one or as a group. The feeding of the cards into the storage area of the rack exposes them to reading sensors that read the face of the card without special markings and retains the relative positioning of the cards (the same order and the same sense (bottom card in the insert area is the bottom card in the card collection area)).

The information read in the smart discard rack is correlated (compared by software in a separate processor) to the original information read from the cards (before or during the deal and play of the hand) to assist in reconstructing each hand of cards.

Sensors indicate face values (suit and rank) when the card is passed over sensors as individual cards are moved through the rack.

The above examples are clearly exemplary and are not intended to be limiting in the practice, disclosure or enablement of the invention. As noted, any image capture device may be used that can read information relating to symbols and can access symbol reading software, any sensor can be sued as a position sensor if it can sense the presence and/or absence of a playing card, drives in the device can be belt drives, gear rives, hydraulic drives, step motor drives or the like, and other variations in software selection, hardware selection, communication modalities and the like are within the skill and selection options of the designer or practitioner.

What is claimed:

1. A method of reading playing cards during a casino card table game comprising:

a. providing a card reading device for reading individual hands of spent playing cards collected at a conclusion of a round of play of the casino table card game;

b. placing a set of playing spent cards comprising individual hands of playing cards, but less than a complete deck of playing cards into a card in-feed area of the card reading device and after a round of play for an individual hand of playing cards, reading only playing cards used in the round of play placed into the in-feed area, c. moving the spent playing cards one at a time from a bottom of the set of spent playing cards in the in-feed area, d. reading at least one of the suit and rank of a spent playing card placed into the in-feed area before the spent playing card is deposited into a playing card collection area of the playing card reading device, and e. determining composition of hands played in the round of play of the casino table card game by sending a signal representing the at least one of rank and suit of each spent playing card in an order in which each spent playing card was placed in the playing card in-feed area, wherein the signal is sent to a processor where the signal of information of at least one of the suit and rank of the individual playing cards is processed and the composition of each hand is determined.

2. The method of claim 1 wherein spent playing cards consist of a single hand of spent playing cards placed into the playing card in-feed area, and only the single hand of spent playing cards is read to determine the single spent hand playing card composition for an identified player position.

3. The method of claim 1 wherein spent playing cards consist of at least a single hand of spent playing cards placed as a group into the playing card in-feed area, but less than a complete deck of playing cards, and only the spent playing cards placed as a group are read to determine the composition of hands at the least one single hand of spent playing cards for an identified player position.

4. The method of claim 1 wherein damaged cards are identified by reading the cards.

5. The method of claim 4 wherein damaged cards are manually replaced.

6. The method of claim 1 wherein spent playing cards consist of multiple hands of spent playing cards placed into the playing card in-feed area, but less than a complete deck of playing cards, and read information is processed by a processor in the card reading device.

7. A method of reading cards during a casino card table game comprising:

a. providing a card reading device for reading spent cards collected at a conclusion of a round of play of the casino table card game;

b. placing a set of spent cards, but less than a complete 52 card deck of cards into a card in-feed area of the card reading device at the conclusion of a round of play of the casino table card game, and after a round of play reading only cards used in the round of play placed into the in-feed area, c. moving the spent cards one at a time from a bottom of the set of spent cards in the in-feed area, d. reading at least one of the suit and rank of a spent card placed into the in-feed area before the spent card is deposited into a card collection area of the card reading device, e. determining composition of at least one hand played in the round of play of the casino table card game by sending a signal representing the at least one of rank and suit of each spent card in an order in which each spent card was placed in the card in-feed area, wherein the signal is sent to a processor where the signal of information of at least one of the suit and rank of the individual cards is processed and the cards in a hand are identified by the processor; and f. displaying information relating to read card information and identified cards in a hand on a display.

8. The method of claim 7 wherein the card collection area is an elevator with a support surface, and the support surface is lowered as more read cards are fed into the card collection area.

9. The method of claim 8 wherein spent cards consist of a single hand of spent cards placed into the card in-feed area.

10. The method of claim 7 wherein images of symbols representing suit and rank are taken discontinuously.

11. The method of claim 10 wherein snapshot images of symbols are triggered by cards being sensed by trigger sensors.

12. The method of claim 7 wherein spent cards consist of a single hand of spent cards placed into the card in-feed area, and only the single hand of spent cards is read to determine the single spent hand card composition.

13. The method of claim 7 wherein spent cards consist of at least a single hand of spent cards placed as a group into the card in-feed area, but less than a complete deck of cards, and only the spent cards placed as a group are read to determine the composition of hands at the least one single hand spent cards.

14. The method of claim 7 wherein spent cards consist of multiple hands of spent cards placed into the card in-feed area, but less than a complete deck of cards.

15. The method of claim 7 wherein the image capture device operates discontinuously to read the at least one of suit and rank of spent cards.

16. The method of claim 7 wherein damaged cards are identified by reading the cards.

17. The method of claim 16 wherein damaged cards are manually replaced.

* * * * *